United States Patent [19]

Bartczak

[11] Patent Number: 4,904,004

[45] Date of Patent: Feb. 27, 1990

[54] MODULAR STRUCTURAL LATCH

[75] Inventor: Andrzej Bartczak, Markham, Canada

[73] Assignee: Magna International Inc., Markham, Canada

[21] Appl. No.: 174,942

[22] Filed: Mar. 29, 1988

[30] Foreign Application Priority Data

Mar. 30, 1987 [CA] Canada ..... 533372

[51] Int. Cl.[4] ..... E05C 3/26

[52] U.S. Cl. ..... 292/216; 292/201; 292/337; 292/DIG. 38

[58] Field of Search ..... 292/337, 216, 280, 201, 292/DIG. 38

[56] References Cited

U.S. PATENT DOCUMENTS

| | | | |
|---|---|---|---|
| 3,782,036 | 1/1974 | Clark et al. | 49/502 |
| 3,876,238 | 4/1975 | Watermann | 292/216 |
| 4,052,094 | 10/1977 | Widén | 292/336.3 |
| 4,073,519 | 2/1978 | Kurozu et al. | 292/DIG. 56 |
| 4,130,308 | 12/1978 | Jeavons | 293/216 |
| 4,193,619 | 3/1980 | Jerila | 292/DIG. 38 X |
| 4,322,958 | 4/1982 | Eigemeier | 70/107 |
| 4,538,845 | 9/1985 | Yamada | 292/216 |
| 4,603,894 | 8/1986 | Osenkowski | 292/337 X |
| 4,647,092 | 3/1987 | Nakamura | 292/337 X |
| 4,735,447 | 4/1988 | Kleefeldt | 292/201 X |

FOREIGN PATENT DOCUMENTS 2460108 7/1976 Fed. Rep. of Germany .

*Primary Examiner*—Richard E. Moore
*Attorney, Agent, or Firm*—Ivor M. Hughes

[57] ABSTRACT

An integrated structural latch for vehicle doors having a structural latching module and a non-structural actuating module; the structural latching module having a metal plate having an opening therethrough and having metal latching mechanisms secured thereto adjacent the opening, the latching mechanisms for engaging a striker passing through the opening, the striker disposed adjacent one end of a vehicle door; the non-structural actuating module being secured to the structural latching module and having a housing with an opening therethrough aligned in use with the opening through the structural latching module and having actuation mechanisms for engaging and disengaging the latching means; whereby the structural latching module and the non-structural actuating module are assembled and when assembled provide an integrated structural latch.

69 Claims, 6 Drawing Sheets

NS
74
75
A2
B2
B3
74a
A3
170a
74
A1
150a
B1
P1
141
166
142
134
133
75a
130
80
140
142
131
162
152
156
183
132
160
135
150
161
169
182
151
180
168
153
167
181

MODULAR STRUCTURAL LATCH

FIELD OF INVENTION

The instant invention relates to latch mechanisms for securing a closure to a body and more specifically to those found in a vehicle.

BACKGROUND OF THE INVENTION

The art of latch design is most assuredly a broad one. A host of patents exist which emphasize various attributes of a latch, whether structural or economical.

U.S. Pat. No. 4,322,958 by Eigemeier refers to a door lock with a spring bolt having a body molded from thermoplastic resin. Further the actuation mechanisms are molded from thermoplastic resins. Although such a structure may have an economical justification in some applications, not all uses would warrant the strength of locking portions exhibited by plastic and particularly for use in vehicles.

U.S. Pat. No. 4,130,308 by Jeavons refers to a motor vehicle door latch having a plastic molding located between front and back plates, the plastic molding for cooperation with a striker to guide it into engagement with the latch. Further an operating lever is molded from plastics materials. Such a mechanism does not however provide an integral structure which can be readily manufactured for quick assembly and precision of fit.

German Offenlegungsschrift 2,460,108 refers to a door lock wherein the components are manufactured from plastic with the exception of the key cylinder and fastening screws. The forces generated by the handle during opening are apparently resolved to avoid damage to the mechanism. However the latching parts do not appear to be strong enough to withstand the substantial loads encountered in vehicles. Further the latching parts are not remotely actuatable.

U.S. Pat. No. 4,538,845 by Yamada refers to a latch mechanism having a one piece molded plastic body having the latch and a release lever mounted thereon. The strength of the pivots for the latching portions would be questionable, without the addition of reinforcing plates, namely the addition of metal front and back plates and metallic actuating levers. Further the metal locking lever does not have specific parts defined within the molded body.

U.S. Pat. No. 3,876,283 by Waterman refers to what is purported to be a two part motor vehicle door latch. However when one reviews the patent one finds a pair of plates between which is sandwiched a molded synthetic-resin body which is attached to the outer plate and carries the locking pawl. Thus a plastic element of the latch is provided for elimination of rattles and squeaks and to provide general noise reduction in the lock. The inner plate carries the operating mechanism of the latch which is secured to the outer plate in assembly. Such assembly is not secured to a structural element of the vehicle. Further, it must be assembled while the door of the vehicle is being assembled.

U.S. Pat. No. 3,782,036 by Clark (referring to FIG. 7) describes a latch mechanism mounted on a reinforcing member. However the aforementioned reference does not provide for latching components which are secured to the structure but merely a lock bolt which passes through the securing flange.

U.S. Pat. No. 4,052,094 by Widen refers to a lock cassette secured to a recess in the end wall of a vehicle door. The lock is made of two main parts, a locking portion, and a control portion. The latch is embodied separately from the adjoining control portion.

Nowhere within the prior art is found an integrated latching mechanism for vehicles wherein the latching components are deliberately structured within a module of metal for strength and may be affixed to a metal reinforcing structural member of a door, and the actuation components are provided in modular form to integrate with the structural components and control the movement of the structural components. The use of plastic in latches for the majority of the prior art is limited in large extent to the damping qualities it brings to reduce noise and rattling. Nowhere within the prior art is found a latch housing module molded having actuation components molded and precisely guided within the compatible recesses found in the molded housing. The housing module also marries with the structural module quickly and efficiently to lend itself to assembly line technologies yet ending with an assembly which has all the advantages of a metal latch for strength and the economics of plastic molding techniques.

It is therefore an object of the invention to provide an integrated modular structural latch from metal in part and plastic in part as load characteristics dictate.

It is a further object of the invention to provide a latch mechanism that is economical yet safe and easily assembled.

It is a further object of the invention that the latch mechanism lends itself to assembly line technologies, yet is easy to maintain.

If is a further object of the invention to reduce the effect of winter conditions on a latch mechanism.

It is a further object of the invention to provide an integrated latch mechanism which will in use connect the forward and rearward pillars of the vehicle door.

Further and other object of the invention will be obvious to those skilled in the art when considering the following summary of the invention and the more detailed description of embodiments of the invention illustrated herein.

SUMMARY OF THE INVENTION

According to one aspect of the invention an integrated structural latch for vehicle doors is provided comprising a structural latching module and a non-structural actuating module; the structural latching module comprising a metal plate having an opening therethrough and having metal latching means (for example a pawl and ratchet) secured thereto adjacent the opening, the latching means for engaging a striker passing through the opening, the striker disposed adjacent one end of a vehicle door, preferably the structural latching module being secured to an intrusion beam disposed within a vehicle door; the non-structural actuating module being secured to the structural latching module and comprising a housing (preferably formed by injection molding techniques) having an opening therethrough aligned in use with the opening through the structural latching module, the non-structural actuating module having disposed therewith actuation means (preferably formed of plastics material) for engaging and disengaging the latching means, of the structural latching module in use, preferably said actuation means being secured within molded channels disposed within and or on the housing in use; and preferably means connecting the actuation means to the latching means; whereby the structural latching module and the non-structural actuating module (which preferably are formed separately) are assembled and when assembled provide an integrated structural latch.

According to another aspect of the invention an integrated structural latch for vehicle doors is provided comprising a structural latching module and a non-structural actuating module; the structural latching module comprising a metal plate having an opening therethrough and having metal latching means, including a ratchet and a pawl, secured thereto adjacent the opening, the latching means for engaging a striker passing through the opening, the striker disposed adjacent one end of a door, preferably the structural latching module being secured to an intrusion beam disposed within a vehicle door; the non-structural actuating module being secured to the structural latching module and comprising a housing (preferably formed by injection molding techniques) having an opening therethrough aligned in use with the opening through the structural latching module, actuation means (preferably formed of plastics material) for engaging and disengaging the latching means, preferably said actuation means being secured within molded channels disposed within and or on the housing in use, and means connecting the actuating means to the latching means; whereby the structural latching module and the non-structural actuating module (which preferably are formed separately) are assembled and when assembled provide an integral structural latch.

According to yet another aspect of the invention an integrated structural latch for vehicle doors is provided comprising a structural latching module and a non-structural actuating module; the structural latching module comprising a metal plate having an opening therethrough and having metal latching means (for example a pawl and ratchet) secured thereto adjacent the opening, the latching means for engaging a striker passing through the opening, the striker disposed adjacent one end of a door, preferably the structural latch module being secured to an intrusion beam disposed within a vehicle door; the non-structural actuating module being secured to the structural latching module and comprising a housing formed by injection molding techniques having an opening therethrough aligned in use with the opening through the structural latching module, actuation means (preferably formed of plastics material) for engaging and disengaging the latching means, said actuation means being secured within molded channels disposed within and or on the housing in use, and means connecting the actuating means to the latching means; whereby the structural latching module and the non-structural actuating module (which preferably are formed separately) are assembled and when assembled provide an integral structural latch.

According to another aspect of the invention an integrated structural latch for vehicle doors is provided comprising a structural latching module and a non-structural actuating module; the structural latching module comprising a metal plate having an opening therethrough and having metal latching means, including a ratchet and a pawl, secured thereto adjacent the opening, the latching means for engaging a striker passing through the opening, the striker disposed adjacent one end of a door, preferably the structural latching module being secured to an intrusion beam disposed within a vehicle door; the non-structural actuating module being secured to the structural latching module and comprising a housing formed by injection molding techniques having an opening therethrough aligned in use with the opening through the structural latching module, actuation means (preferably formed of plastics material) for engaging and disengaging the latching means, said actuation means being secured within molded channels disposed within and or on the housing in use, and means connecting the actuating means to the latching means; whereby the structural latching module and the non-structural actuating module (which preferably are formed separately) are assembled and when assembled provide an integral structural latch.

According to yet another aspect of the invention the actuation means may comprise at least two actuating levers, the levers preferably being secured within molded channels disposed within the housing.

According to another aspect of the invention the actuation means may comprise at least two actuating levers formed from thermoplastic material, the levers being secured within molded channels disposed within the housing.

According to another aspect of the invention the plate within the structural latching module may comprise an extension extending in a direction parallel to the extension of an intrusion beam and substantially normal to the extension of the structural latching module.

According to yet another aspect of the invention the plate within the structural latching module may comprise an extension of an intrusion beam, said extension extending in a direction substantially normal to the extension of the intrusion beam, the extension having metal latching means secured thereto.

According to yet another aspect of the invention the latching means may comprise a resiliently biased ratchet and a pawl preferably pivotably mounted on opposite sides of the opening for engagement with a striker, the striker mounted on a pillar adjacent a vehicle door, preferably the ratchet and pawl extending parallel to the extension of said structural latching module.

According to yet another aspect of the invention the structural latching module may comprise handle means secured to the metal plate for unlocking the latch.

According to yet a further aspect of the invention the structural latching module may comprise an integral bracket for a key cylinder, the bracket extending from the metal plate preferably in a direction substantially normal to the extension of the structural latching module.

According to yet another aspect of the invention the non-structural actuating module may comprise resilient pads disposed within the housing for securing a striker adjacent the opening in the housing.

According to another aspect of the invention the integrated structural latch may comprise holes extending through the housing of the non-structural module through which threaded pins extend to secure the housing by the pins to the structural latching module within threaded holes disposed on the pivots for a ratchet and pawl.

According to yet another aspect of the invention the non-structural module may comprise at least one cable release means secured to the actuation means for disengaging the latch.

According to another aspect of the invention the non-structural actuation module may comprise electric actuation means connected to at least one actuating lever for locking and unlocking a vehicle door, preferably said actuating lever having connecting means to connect the at least one actuating lever to the electric actuation means.

According to yet another aspect of the invention the integrated structural latch may comprise electric actuation means connected to at least one actuating lever of the non-structural module, and an integral bracket for a key cylinder extending from the metal plate of the structural latching module through which a key cylinder extends, the key cylinder having means to connect the electric actuation means thereto, and preferably further to connect the electric actuation means to connecting means to the at least one actuation means; thereby locking and unlocking the integrated structural latch.

The preferred embodiment will now be described in detail in relation to the accompanying figures.

According to another aspect of the invention is provided an integrated structural latch for vehicle doors comprising a structural latching module and a non-structural latching module;

the structural latching module comprising a metal plate having an opening therethrough and having a ratchet disposed on one side of the opening and a pawl disposed on the other side thereof, the ratchet and pawl being pivotably mounted and resiliently biased, and being secured to the metal plate upon the interior thereof;

the metal plate being bent at substantially 90° to form two substantially parallel brackets extending outwardly away from the pawl and the ratchet, the bracket extensions, one being longer than the other, for securing the metal plate to an intrusion beam proximate the opening, the bracket extension proximate the opening having a further opening therethrough at substantially 90° to the opening within the metal plate, the bracket extension remote the opening providing structural support for the integrated latch mechanism, the ratchet and pawl extending in a plane substantially parallel to the extension of the metal plate, the ratchet having disposed therethrough proximate the opening in the metal plate a notch for receiving a striker in use, and having disposed on one side of the notch a primary detent means for engagement with the pawl, having disposed on the other side of the notch a secondary detent for engagement with the pawl: the pawl being disposed upon the opposite side of the opening in the metal plate having a detent means at one end thereof proximate the ratchet and having a tail portion remote said detent at the other end thereof;

the non-structural actuating module being secured to the structural latching module and comprising a housing formed by injection molding techniques having an opening therethrough aligned in use with the opening through the metal plate of the structural latching module, having two actuation levers formed from thermoplastic materials extending in use at substantially 90° to the extension of said opening, the first actuating lever being secured within a molded channel disposed within the housing and formed during the formation of the housing, said actuation lever having disposed upon one end thereof proximate the opening a detent portion and an elongated slot, and having formed at the other end thereof, remote said opening an elongated slot and means to secure a remote actuating device thereto, the second actuating lever being formed from thermoplastic materials and being secured in a molded channel disposed within the housing and formed during the formation of said housing, the second actuation lever having disposed at one end thereof a pivotable release lever, said release lever having an arm extending therefrom for engagement with the pawl mechanism of the structural latching module, the actuating lever having disposed at the same end proximate the release lever, an elongated slot, and having formed at the other end thereof remote said release lever an elongated slot and an abutting surface, said abutting surface providing stop means for the movement of the second actuating lever within its channel: having a locking lever extending substantially at 90° the extension of said ratchet mechanism in use, and having disposed upon its surface proximate said actuating levers a pin, said pin extending through the elongated slots disposed upon the actuating levers proximate said opening, the locking lever having attached thereto remote actuation means exterior to the housing for pivoting said locking lever thus engaging or disengaging said secondary actuating lever;

whereby in use the structural latching module and the non-structural actuating module marry to form the modular structural latch, wherein all actuation components are contained within the actuation module, and all of the latching components are contained within the structural module.

According to another aspect of the invention is provided a key cylinder mounted on the metal plate on an extension arm of the metal plate, said extension arm having an annular bracket for securing a key cylinder therein, the key cylinder having a detent at one end remote a key slot within said cylinder, the detent for fastening to an actuation lever which fastens to the locking lever of the actuation module.

According to another aspect of the invention is provided the structural latch wherein a handle secured to the metal plate proximate the bracket extension for fastening the metal plate to an intrusion beam, said handle for engagement with the secondary actuating lever of the actuating module by an eccentric detent formed as an extension of the handle.

According to another aspect of the invention is provided the structural latch wherein the remote actuation means affixed to the first actuating lever is a cable release.

BRIEF DESCRIPTION OF THE PREFERRED EMBODIMENTS

DETAIL DESCRIPTION OF THE PREFERRED EMBODIMENTS

Figure 1:
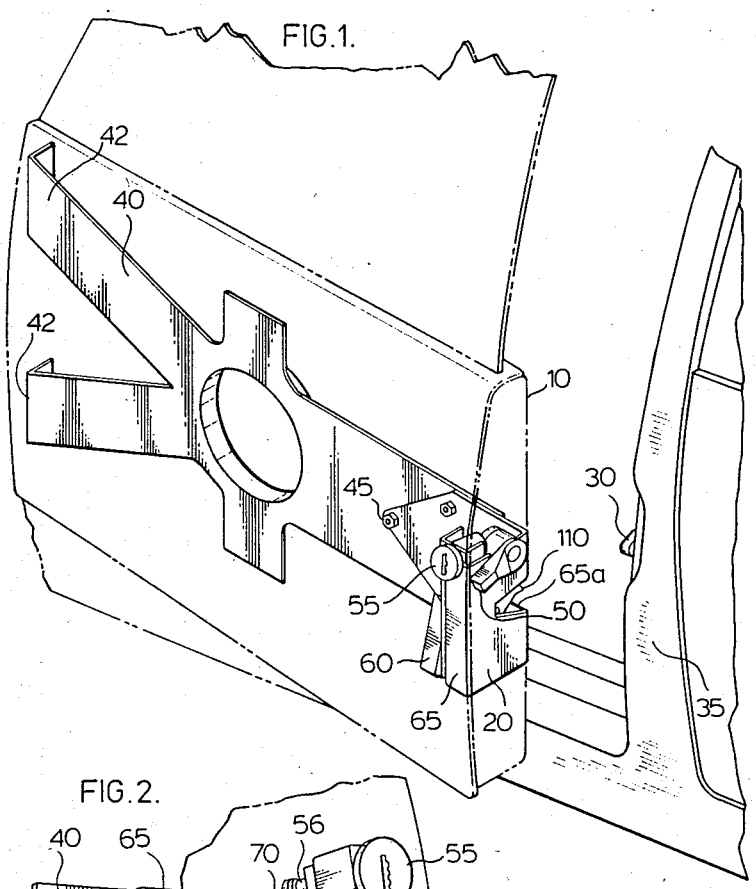
FIG. 1 is a perspective view of the modular structural latch mounted on a vehicle door in a preferred embodiment of the invention.

Referring now to FIG. 1, a vehicle door is illustrated in perspective being hingedly mounted on a vehicle body. Within the vehicle door 10 is mounted an intrusion beam 40 secured to the aforementioned hinge members at 42 and having mounted at the other end secured by fasteners 45 to intrusion beam 40, a latch mechanism 20 for cooperation with a striker 30 mounted on a pillar of an automobile 35. The latch has a number of major components which integrate to provide all the functions necessary of a latch in an automobile. A key cylinder 55 is mounted at the top of the latch, a handle 50 is pivotly mounted adjacent the key cylinder. The key cylinder is attached at the rear thereof to a motor 60 for manually or electrically locking the latch. Striker 30 upon closing the door enters opening 65(*a*) and thereat is secured by ratchet 110. The ratchet is secured to a metal plate 65 which provides the structural support for latch 20 and the components thereof.

Figure 2:
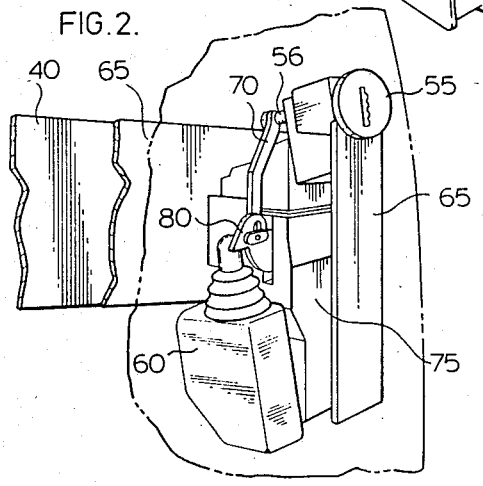
FIG. 2 is a close-up perspective view of the latch of FIG. 1 illustrating the major components of the latch in a preferred embodiment of the invention.
Figure 5:
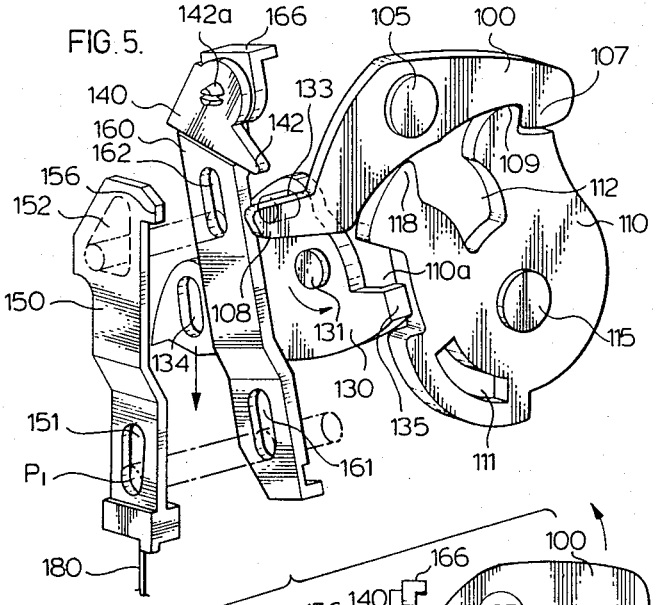
FIG. 5 is an illustration of the interconnection of the latching parts of the structural module and the actuating levers of the non-structural actuation module illustrated in exploded perspective in a preferred embodiment of the invention.

Referring now to FIG. 2, wherein a more detailed view of the components described in relation to FIG. 1 are illustrated, plate 65 is illustrated providing the structural support for the latch 20. The plate 65 is attached to the intrusion beam 40 (the fasteners are not shown). Also attached to structural plate 65 is a thermoplastic housing 75 molded using conventional injection molding techniques. Attached to the housing 75 is a motor 60 attached to the module at detent 80 of locking lever 130 (as illustrated in FIG. 5). Attached to detent 80 is external lever 70 which is attached to key cylinder 55 at the rear thereof by pin 56 (as best illustrated in FIG. 3) so as to provide motivation for the locking and unlocking of the latch by a vehicle operator when wishing to lock the vehicle door using a key or a remote device.

Figure 3:
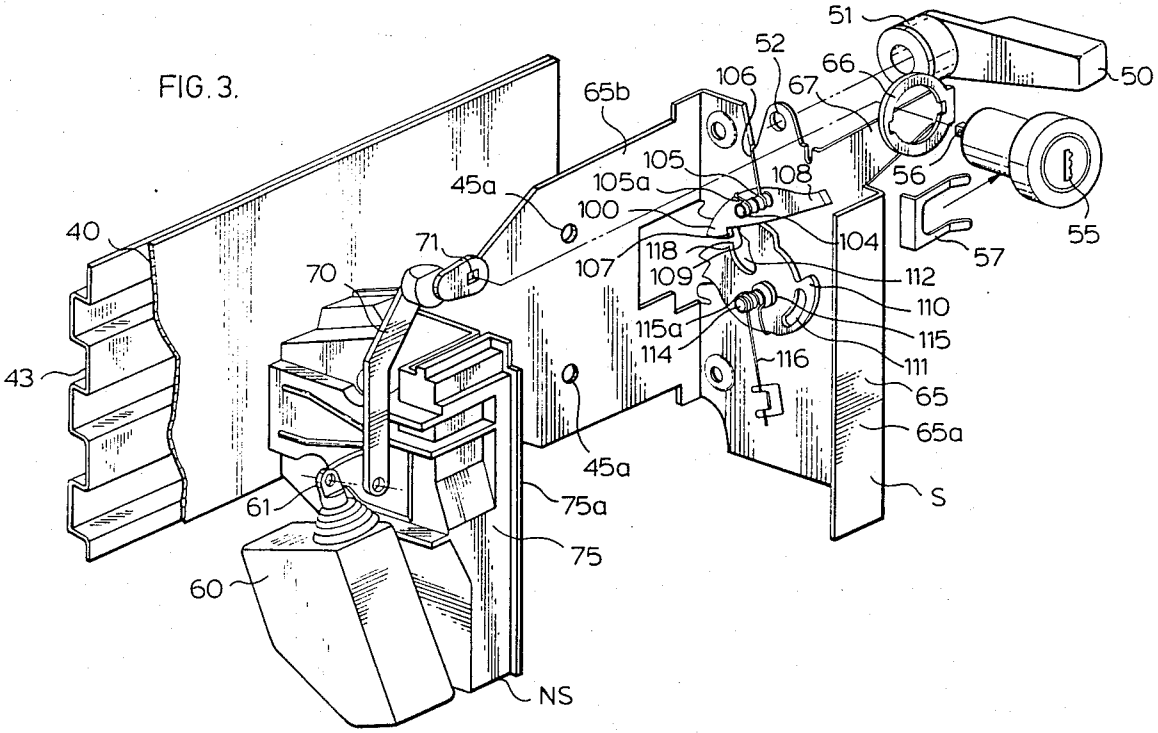
FIG. 3 is an exploded perspective view of the latch illustrating the structural latching component and parts thereof and the non-structural actuating component and parts thereof in a preferred embodiment of the invention.
Figure 9:
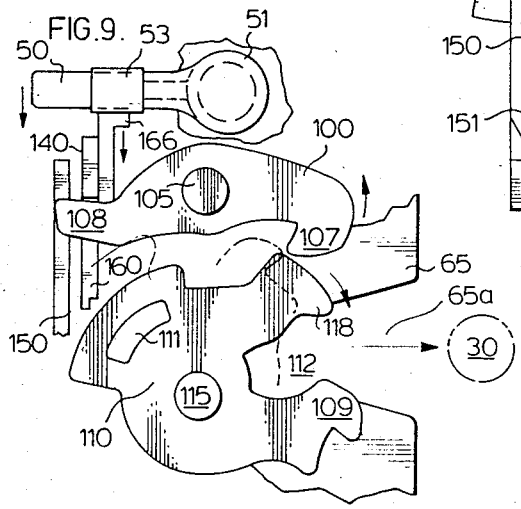

Referring now to FIG. 3, wherein an exploded view of the latch is illustrated. The non-structural actuation module NS is formed from a housing 75, injection molded from thermoplastic materials having a motor 60 attached on the exterior thereof and having peripheral flanges which allow for interlocking with the structural module. Structural module S is made up of metal plate 65 having mounted thereon on opposite sides of opening 65(*a*) a ratchet 110 and a pawl 100 resiliently biased by springs 116 and 106 respectively. The pawl is mounted above the ratchet upon pivot 105 having a tail at one end 108 and a detente 107 at the end proximate 65(*a*). The pivot 105 has a cylindrical extension 105(*a*) through which a threaded bore is disposed 104 for receiving a threaded fastener. The threaded fastener will extend from the plastic housing of the actuation module through to the pivot. In a similar fashion ratchet 110 is pivotably mounted on pivot 115 having a cylindrical extension 115 extending therefrom and having a threaded orifice thereof 114. The threaded orifice 114 is for receiving in like manner a threaded pin extending through the plastic housing of the actuation module. Both pins extending through the housing will hence secure the housing to the structural plate 65. The metal plate 65 has an extension at the top thereof 67 at the end of which is disposed a bracket 66 for retaining the key cylinder 55 therein the key cylinder 55 having a pin 56 for engagement with an orifice 71 of actuation lever 70. The bracket 65 also contains a handle 50 having a central pivot 51 and an eccentric detent 53 as best illustrated in FIG. 9. The handle for engagement with the actuation levers of the actuation module in S. A pin 57 is provided for securing the key cylinder 65 to the bracket 66. The metal plate 65 is secured to intrusion beam 40 at holes 45(*a*) by fasteners 45 as best illustrated in FIG. 1. Intrusion beam 40 is illustrated having an inner and an outer metal portion, the inner portion being a flat portion and the outer portion 43 being a corrugated portion.

Figure 4:
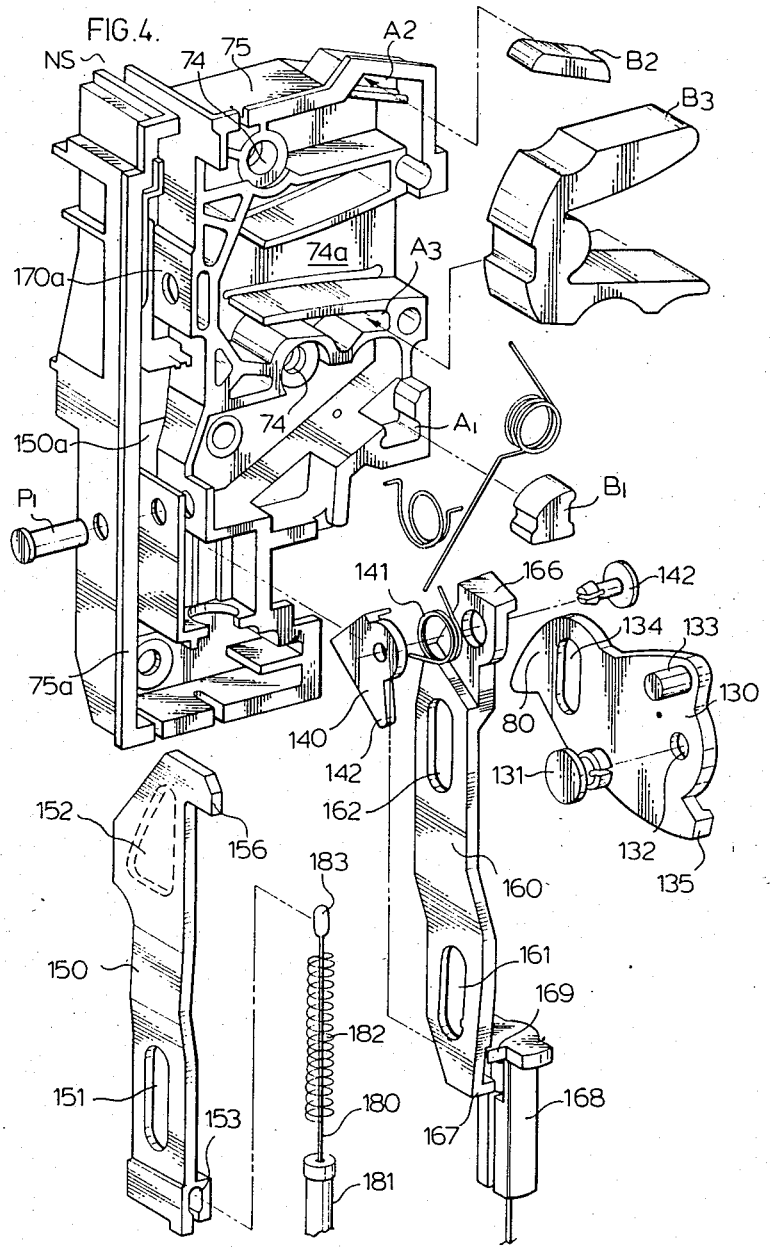
FIG. 4 is a detailed exploded view of the non-structural actuation module and parts thereof illustrated in a preferred embodiment of the invention.

Referring now to FIG. 4, the non-structural actuation module in S is illustrated in exploded perspective having a housing 75 molded by conventional injection molding techniques having an exterior peripheral flange 75(*a*) for fastening and abutting with the structural latching module brackets 65(*a*) and 65(*b*). Two orifices 74 are disposed on opposite sides of opening 74(*a*) passing through housing 75. The opening 74(*a*) cooperates with the opening 65(*a*) of the structural module in securing striker 30. Threaded pins not shown, pass through openings 74 and are secured to cylinders 105(*a*) and 115(*a*) respectively mounted on the pivots of the pawl and ratchet mechanisms of the structural module. Bumper pads B1, B2, and B3 which abut openings A1, A2, and A3 in the housing provide resilient support for fastening the striker 30 within cooperative openings 65(*a*) and 74(*a*) respectively. The bumpers B2, B3, and B1 further provide a tighter fit between the structural latching module and the non-structural actuating module in use. The housing 75 has formed therein guides 170(*a*) and 150(*a*) for controlling the movement of inside actuating lever 150 and outside actuating lever 160. Outside actuating lever 160 can be activated by the key cylinder or electric motor as illustrated in 55 as illustrated in FIG. 2 or the handle 50 as illustrated in FIG. 3. A release lever 140 is provided at one end of the outside actuation lever 160. The release lever 140 is resiliently biased and secured to lever 160 by pin 142(*a*) release lever 140 has at one end an extending arm 142. The arm 142 is for releasable engagement with the pawl 100 of the structural latching module. The actuating lever 150 has two elongated orifices disposed thereon, one at the top 152 and one at the bottom 151 in the illustrations. Further actuation lever 160 has an elongated orifice at the top 162 and an elongated orifice at the bottom 161. These orifices on the actuating levers cooperated at the bottom win pin P1 of the housing 75 and pin 133 of locking lever 130. Both elongated slots are for the purpose of controlling the movement of both actuating levers in use. The locking lever 130 has a detent at one end thereof 80 and rectangular tooth 135 at the other end thereof which is optional. The detent 80 and elongated slot 134 are for cooperative engagement with motor 60 and key cylinder 55. This cooperative engagement will be described in relation to FIGS. 7 through 11. Actuation lever 150 has attached thereto at the bottom cable release 180 contained in sheath 181 resiliently biased by spring 182 and fastener 183. The fastener 183 conveniently fits with orifice 153 and secures in the orifice. At the other end of the actuating lever 150 is found a hook portion 153 for cooperative engagement with the pawl mechanism 100 of the structural latching module. Actuation lever 160 has at one end an abutting surface 166 which cooperates with the outside handle 50 upon the actuation thereof being eccentric detent 53 as best illustrated in FIG. 8. At the other end of lever 160 is an abutting surface 167 which is abutted by cooperative surface 169 of stop mechanism 168. Stop mechanism 168 controls the movement forwardly of actuating lever 160. Such cooperation of levers 160, 150, 140, and 130 are all integrally assembled within housing 75 within channels 170(*a*) and 150(*a*) and 130(*a*) not shown. When assembled the actuation module has all of its components positioned such that it will perfectly marry with the components of the structural module.

Referring again to FIG. 4, resilient bumpers B1, B2, and B3 provide a tight fit for the latching mechanism in that the housing will snugly be secured to the metal plate. In providing such a tight fit the latch in operation will not rattle or squeak but provide a firm grip on the striker 30 retained within notch 112 of ratchet 110 secured with an opening 65(*a*) cooperative with opening 64(*a*) in preventing the rattling of striker 30 in said opening.

Figure 6:
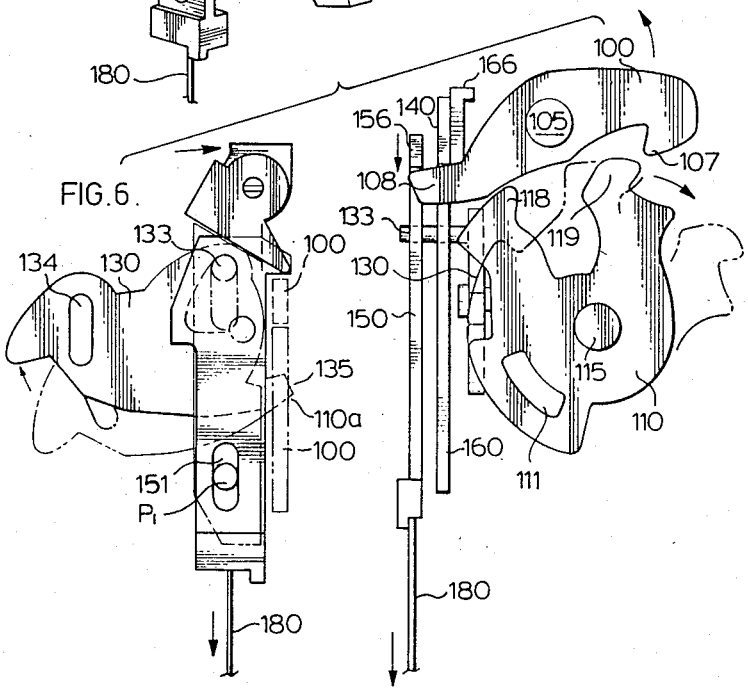
FIG. 6 is a side and a front view illustrating the components of FIG. 5 and the interrelationships thereof in a preferred embodiment of the invention.

Referring now to FIGS. 5 and 6, the interrelationship between and amongst all the operating mechanisms of the non-structural actuating module are illustrated. Further the ratchet and pawl of the structural latching module are illustrated and their interrelationships will now be described. Referring firstly to FIG. 5 all the mechanisms are illustrated separate from their modules in an attempt to illustrate the interrelationships therebetween. Release lever 140 is illustrated attached by pin 142(*a*) to actuating lever 160 at the top thereof. The arm 142 extends toward the tail 108 of pawl mechanism 100. The release lever 140 is resiliently biased about its pivot 142(*a*). Actuation lever 160 has at the top of its extension abutting surface 166 for cooperative engagement with eccentric handle portion 53 of handle 50. As best illustrated in FIG. 8, actuation lever 150 is illustrated having upon its top a hook portion 156 for engagement with the tail 108 of pawl mechanism 100. Pin 133 is secured upon the surface of locking lever 130 and passes through elongated slots disposed adjacent the top of both actuating levers 150 and 160. The locking lever 130 has at its end remote the pawl and ratchet devices an elongated slot 134 for interconnection with the actuation lever 70 as best illustrated in FIG. 2 and FIG. 3, which allows for the operation of the locking lever by the key cylinder or electric motor 55. At the opposite end of locking lever 130 is disposed a rectangular segment 135. The rectangular segment 135 is an optional construction which is included in a preferred embodiment, it being understood that the latch would work equally well without the extra portion 135. As best illustrated in FIG. 6 it is apparent that square segment or rectangular segment 135 is rotated as locking lever 130 is rotated to position itself within opening 110(*a*) of ratchet 110. Pin P1 extends through elongated slots disposed upon the bottom of each of the actuating levers 150 and 160. The pin is included in the construction to control the amount of extension of both actuating levers. The ratchet 110 has an opening 112 in which striker 30 would be secured in use. The ratchet has detents 109 and 118 on either side of the opening 112. The detents are for primary locking engagement and secondary locking engagement with the pawl 100 at hook portion 107 of the pawl. Hence a primary locking position is defined by interengagement between detent 109 and a portion 107, and the secondary locking engagement for safety sake is provided by the locking engagement of detent 118 and hook portion 107. The pawl and ratchet are cooperatively mounted on the metal plate of the structural latching module. An arcuate opening 111 is provided through the ratchet at the end remote the opening 112. The arcuate opening is provided as a reduction in the amount of metal required to manufacture the ratchet in a zone where it is not required for strength, and further to provide a balance in the overall structure of the ratchet when defining the centre of mass thereof.

Referring now to FIG. 6 the rotation of ratchet 110 is illustrated, showing in dash marks the position of the ratchet when released. The interrelationship between the tail 108 of pawl mechanism 100 and actuating lever 160 and release lever 140 and locking lever 130 is also illustrated. As can be readily seen from FIG. 6, the pawl may be rotated in a counterclockwise direction by engagement with the actuating lever 150 or actuating lever 160 or by outside handle abutting the top surface 166 of actuating lever 160 provided that locking lever 130 is not rotated in such a way as to rotate the actuating levers 150 and 160 out of plane with the tail 108 of pawl 100 whereat such rotation will prevent the engagement of actuating lever 160 the abutting surface 166 and exterior handle 150, and will also prevent the engagement of arm 142 of release lever 140 both of which have been swung out of position such that they will not interfere nor contact the tail 108 of the pawl 100. However actuating arm 150 will be able to still contact pawl tail 108 by a hook portion 156 by pulling on a handle attached to cable released means 180. The pin 133 is illustrated in FIG. 6 and its position in relation to the elongated slots thereby controlling the positioning of the levers 150 and 160 respectively.

Opening 152 at the top of actuating lever 150 has a generally triangular shape and allows for the movement of locking lever 130 without disengaging hook portion 156 from pawl tail 108.

Figure 7:
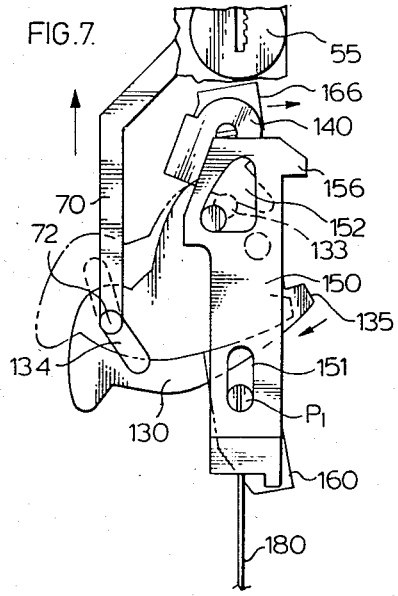
FIGS. 7 through 11 are views illustrating the operating interrelationships of the components of FIG. 5 during the latching and unlatching cycles in a preferred embodiment of the invention.
Figure 8:
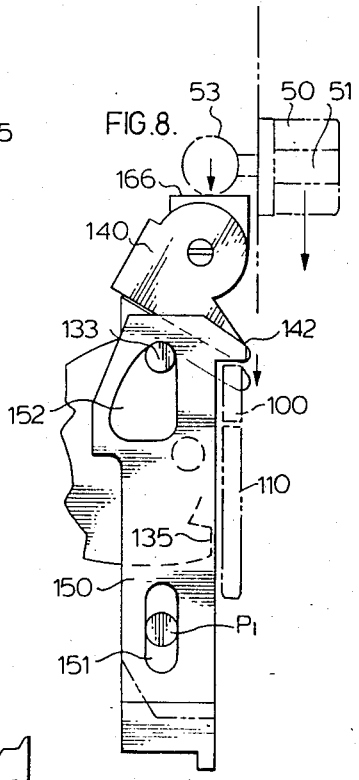

Referring now to FIGS. 7 through 11, the operation and interrelationship of the mechanisms is illustrated. The interrelationship is shown to provide more information on the operation of the latch mechanism providing, locking of the latch via a key or remote device (not shown) and key cylinder 55 or motor 60 interconnected with actuating lever 70 interconnected with locking lever 130. The locking lever 130 has a pin 133 connected thereto for engagement with the elongated slots upon the top of actuating levers 150 and 160. As best illustrated in FIG. 7 the movement of the pin 133 is shown and specifically within the triangular opening 152 of actuating lever 150. The movement of the pin will disengage lever 160 by rotating it and the release lever 140 out of plane with the pawl mechanism 100, however hook portion 156 will remain in contact with the tail portion 108 of pawl 100. Pin P1 passing through elongated slots 151 and 161 of the actuating levers 150 and 160 control the movement and the extension of the levers. Thus by turning a key within cylinder 55 or remotely actuating motor 60 the locking lever is moved upwardly and downwardly. The movement thereof causes the actuating lever 160 to move in a clockwise or a counterclockwise direction. Such movement will prohibit any individual attempting to open the door of the vehicle from the outside via handle 50 as illustrated in FIG. 1. Until such time as lever 160 is rotated in the direction shown in FIG. 7 and moved back into parallel engagement with actuation lever 150. As best shown in FIG. 8 lever 160 is illustrated with release lever 140 being forced in a downward direction having been rotated into a position of engagement. The release lever 140 engages the pawl 108 via arm 142 thereby causing ratchet mechanism 110 to be released. Further in being released the locking lever 130 in rotating to a position of unlocking the vehicle door as shown in FIG. 8 has rectangular segment 135 disjointed from engagement with ratchet 110.

In FIG. 9 striker 30 is illustrated being released following the sequences of events described in the aforementioned paragraph whereby the detent 118 and 109 of ratchet mechanism 110 are not engaged with the hook portion 107 of pawl 100 as the actuation levers 150 or 160 being parallel in disposition have caused the rotation of the pawl in the counterclockwise direction and in this specific case the rotation being motivated by movement by handle 50 opening the door. The abutment of eccentric portion 53 of handle 50 and abutting surface 166 of lever 160 is clearly illustrated illustrating the movement of actuation lever 160 downwardly causing release lever 140 to engage the tail 108 of pawl 100 and thereby release the ratchet mechanism as previously described.

Figure 10:
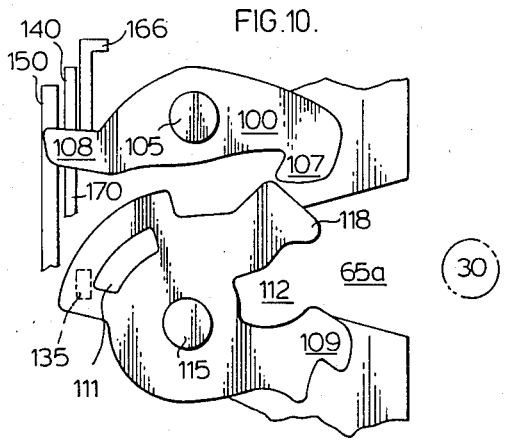

FIG. 10 illustrates the ratchet and pawl in position in relation to the actuation and release lever when a striker 30 is to be engaged in opening 65(*a*) and recess 112 of the latch mechanism.

Figure 11:
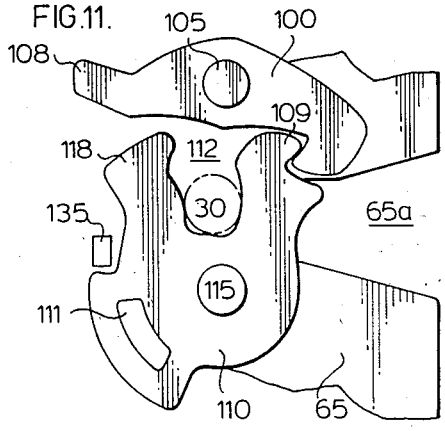

FIG. 11 illustrates the fully latched position of pawl 100 and ratchet 110. Illustrating the positioning of rectangular segment 135 of locking lever 130 which would be rotated if the ratchet were inadvertently released.

Should an individual attempt to actuate lever 150 and actuate 160 at the same time, release lever 140 will rotate preventing the breakage of either actuation levers. Thus the need to have metal release levers is negated.

In summary, an integrated latching structure comprising a structural module and an actuation module separated in construction yet integrated in use is provided. The metal portions provide the strength, enhance the safety as required by latching mechanisms in engagement with a striker. The latching mechanism is further secured to an intrusion beam which provides an interconnection between the pillars disposed at either end of a vehicle door. Such interconnection providing a rigid structure during for example, an accident or collision from the side. The plastic portions formed from plastic resins of suitable durability and strength, the plastic material being in one instance polyacetyl. But of course any suitable plastic material may be used. The bumpers need only be constructed from a resilient material.

As best illustrated in FIG. 5 the locking lever 130 is disposed at substantially a 90 degree plane to that of the extension of the ratchet 110.

In an alternative embodiment it would not be necessary to include release lever 140 at the top of actuation lever 150 if it were constructed of metal. The release lever is incorporated in the design to absorb the forces that would occur if both actuation levers were actuated at the same time. Therefore a slippage is built into the system if such incident would occur. The integrated structural latch provided will be easily assembled and lend itself to an assembly line technology, or will be just as readily assembled by manual labour techniques. The fittings are snap fittings and plastic rivets which have not be illustrated in the diagrams, and may be of any configuration. The ease of assembly and the modular construction of the latch provides for ease of maintenance should any of the portions require same. The actuation module may be removed and an entire new one may be substituted in its place without removal of the pawl and ratchet mechanisms from the structural module. The portions of the actuation module used in controlling the operation of the latch will not rust and will be much quieter than the normal latch operation. The use of the latch during the winter months further will improve beyond normal metal latches by offering resistance to freezing of the latch caused by weathering of the structure. The motor illustrated in FIG. 2 (item 60) is a very small DC motor providing high torque at low speed. In a preferred embodiment a force of 9 lbs is generated. A solenoid is not recommended in this use as it is not as reliable as the electric motor.

As best illustrated in FIG. 3 metal plate 65 of structural module S has a bracket portion 65(*a*) extending towards the housing in use. The housing having peripheral flange 75(*a*) abutting the interior surface of metal plate 65 and being surrounded on two sides by metal bracket 65(*a*) and extension 65(*b*) proximate the intrusion beam. Thus the metal plate provides a recess into which the housing of the actuation module may be inserted, thereby securing the actuation module in position further being positioned and affixed by fastening braces not shown. Two of which such fastening devices are threaded pins extending into the extensions of pivots 114 and 104 respectively.

As many changes can be made to the preferred embodiments without departing from the scope of the invention, it is intended that all matter contained herein be interpreted as illustrative of the invention and not in a limiting sense.

The embodiments of the invention in which an exclusive property or privilege is claimed are as follows:

1. An integrated structural latch for vehicle doors comprising a structural latching module and a non-structural actuating module;

the structural latching module comprising a metal plate having an opening therethrough and having metal latching means secured thereto adjacent the opening, the latching means for engaging a striker passing through the opening, the striker disposed adjacent one end of a vehicle door;

the non-structural actuating module being secured to the structural latching module and comprising a housing having an opening therethrough aligned in use with the opening through the structural latching module, the non-structural actuating module having disposed therewith actuation means for engaging and disengaging the latching means of the structural latching module in use;

whereby the structural latching module and the non-structural actuating module are assembled and when assembled, provide an integrated structural latch.

2. The latch of claim 1, wherein the structural latching module is secured to an intrusion beam disposed within a vehicle door.

3. The latch of claim 1, wherein the housing is formed by injection molding techniques.

4. The latch of claim 2, wherein the housing is formed by injection molding techniques.

5. The latch of claim 1, wherein the actuation means are formed of plastic material.

6. The latch of claim 2, wherein the actuation means are formed of plastic material.

7. The latch of claim 1, wherein the actuation means are secured within molded channels disposed within and or on the housing in use.

8. The latch of claim 2, wherein the actuation means are secured within molded channels disposed within and or on the housing in use.

9. The latch of claim 5, wherein the actuation means are secured within molded channels disposed within and or on the housing in use.

10. The latch of claim 6, wherein the actuation means are secured within molded channels disposed within and or on the housing in use.

11. The latch of claim 1, wherein means for connecting the actuation means to the latching means is provided.

12. The latch of claim 2, wherein means for connecting the actuation means to the latching means is provided.

13. The latch of claim 5, wherein means for connecting the actuation means to the latching means is provided.

14. The latch of claim 6, wherein means for connecting the actuation means to the latching means is provided.

15. An integrated structural latch for vehicle doors comprising a structural latching module and a non-structural actuating module;

the structural latching module comprising a metal plate having an opening therethrough and having metal latching means, including a ratchet and a pawl, secured thereto adjacent the opening, the latching means for engaging a striker passing through the opening, the striker disposed adjacent one end of a door;

the non-structural actuating module being secured to the structural latching module and comprising a housing having an opening therethrough aligned in used with the opening through the structural latching module, actuation means for engaging and disengaging the latching means, and means connecting the actuating means to the latching means;

whereby the structural latching module and the non-structural actuating module are assembled and when assembled, provide an integral structural latch.

16. An integrated structural latch for vehicle doors comprising a structural latching module and a non-structural actuating module;

the structural latching module comprising a metal plate having an opening therethrough and having metal latching means secured thereto adjacent the opening, the latching means for engaging a striker passing through the opening, the striker disposed adjacent one end of a door;

the non-structural actuating module being secured to the structural latching module and comprising a housing formed by injection molding techniques having an opening therethrough aligned in use with the opening through the structural latching module actuation means for engaging the disengaging the latching means, said actuation means being secured within molded channels disposed within and or on the housing in use, and means connecting the actuating means to the latching means;

whereby the structural latching module and the non-structural actuating module are assembled and when assembled provide an integral structural latch.

17. An integrated structural latch for vehicle doors comprising a structural latching module and a non-structural latching module;

the structural latching module comprising a metal plate having an opening therethrough and having metal latching means, including a ratchet and a pawl, secured thereto adjacent the opening, the latching means for engaging a striker passing through the opening, the striker disposed adjacent one end of a door;

the non-structural actuating module being secured to the structural latching module and comprising a housing formed by injection molding techniques having an opening therethrough aligned in use with the opening through the structural latching module, actuation means for engaging and disengaging the latching means, said actuation means being secured within molded channels disposed within and or on the housing in use, and means connecting the actuating means to the latching means;

whereby the structural latching module and the non-structural actuating module are assembled and when assembled provide an integral structural latch.

18. The integrated structural latch of claim 1 or 2, wherein the actuating means further comprises at least two actuating levers.

19. The integrated structural latch of claim 15 or 16, wherein the actuating means further comprises at least two actuating levers.

20. The actuation means of claim 18, wherein the levers are secured within molded channels disposed with the housing.

21. The actuation means of claim 18, wherein the at least two actuating levers are formed from thermoplastic material.

22. The structural latching module of claim 1, 2 or 15, wherein the plate has an extension extending in a direction parallel to the extension of an intrusion beam and substantially normal to the extension of the structural latching module.

23. The structural latching module of claim 16 or 17, wherein the plate has an extension extending in a direction parallel to the extension of an intrusion beam and substantially normal to the extension of the structural latching module.

24. The structural latching module of claim 1, 2 or 15, wherein the plate is an extension of an intrusion beam, said extension extending in a direction substantially normal to the extension of the intrusion beam, the extension having metal latching means secured thereto.

25. The structural latching module of claim 16 or 17, wherein the plate is an extension of an intrusion beam, said extension extending in a direction substantially normal to the extension of the intrusion beam, the extension having metal latching means secured thereto.

26. The latching means of claim 1, 2 or 15, comprising a resiliently biased ratchet and pawl for engagement with a striker, the striker mounted on a pillar adjacent a vehicle door.

27. The latching means of claim 16 or 17, comprising a resiliently biased ratchet and pawl for engagement with a striker, the striker mounted on a pillar adjacent a vehicle door.

28. The latching means of claim 24, wherein the ratchet and pawl are pivotably mounted on opposite sides of the opening.

29. The latching means of claim 24, wherein the ratchet and pawl extend parallel to the extension of the structural latching module.

30. The structural latching module of claim 1, 2 or 15, comprising handle means secured to the metal plate for unlocking the latch.

31. The structural latching module of claim 16 or 17, comprising handle means secured to the metal plate for unlocking the latch.

32. The structural latching module of claim 1, 2 or 15, comprising an integral bracket for a key cylinder, the bracket extending from the metal plate.

33. The structural latching module of claim 16, or 17, comprising an integral bracket for a key cylinder, the bracket extending from the metal plate.

34. The structural latching module of claim 32, wherein the bracket extends in a direction substantially normal to the extension of the structural latching module.

35. The non-structural actuating module of claim 1, 2 or 15, comprising resilient pads disposed within the housing for securing a striker adjacent the opening in the housing.

36. The non-structural actuating module of claim 16 or 17, comprising resilient pads disposed within the housing for securing a striker adjacent the opening in the housing.

37. The non-structural actuating module of claim 3, 4 or 7, comprising resilient pads disposed within the housing for securing a striker adjacent the opening in the housing.

38. The non-structural actuating module of claim 15, or 16, comprising resilient pads disposed within the housing for securing a striker adjacent the opening in the housing.

39. The non-structural actuating module of claim 30, comprising resilient pads disposed within the housing for securing a striker adjacent the opening in the housing.

40. The non-structural module of claim 1 or 2, comprising at least one cable release means secured to the actuation means for disengaging the latch.

41. The non-structural module of claim 15, or 16, comprising at least one cable release means secured to the actuation means for disengaging the latch.

42. The non-structural module of claim 17, comprising at least one cable release means secured to the actuation means for disengaging the latch.

43. The non-structural actuation module of claim 1 or 2, comprising electric actuation means connected to at least one actuating lever for locking and unlocking a vehicle door.

44. The non-structural actuation module of claim 15 or 16, comprising electric actuation means connected to at least one actuating lever for locking and unlocking a vehicle door.

45. The non-structural actuation module of claim 17 or 18, comprising electric actuation means connected to at least one actuating lever for locking and unlocking a vehicle door.

46. The integrated structural latch of claim 1 or 2, comprising electric actuation means connected to the at least one actuating lever of the non-structural module, and an integral bracket for a key cylinder extending from the metal plate of the structural latching module through which a key cylinder extends, the key cylinder having means to connect the electric actuation means thereto, thereby locking and unlocking the integrated structural latch.

47. The integrated structural latch of claim 3, 4, or 7, comprising electric actuation means connected to the at least one actuating lever of the non-structural module, and an integral bracket for a key cylinder extending from the metal plate of the structural latching module through which a key cylinder extends, the key cylinder having means to connect the electric actuation means thereto, thereby locking and unlocking the integrated structural latch.

48. The integrated structural latch of claim 11 or 15, comprising electric actuation means connected to the at least one actuating lever of the non-structural module, and an integral bracket for a key cylinder extending from the metal plate of the structural latching module through which a key cylinder extends, the key cylinder having means to connect the electric actuation means thereto, thereby locking and unlocking the integrated structural latch.

49. The integrated structural latch of claim 16, 17, or 18, comprising electric actuation means connected to at least on actuating lever of the non-structural module, and an integral bracket for a key cylinder extending from the metal plate of the structural latching module through which a key cylinder extends, the key cylinder having means to connect the electric actuation means thereto, thereby locking and unlocking the integrated structural latch.

50. The latch of claim 15 or 16, wherein the structural latching module is secured to an intrusion beam disposed within a vehicle door.

51. The latch of claim 17, wherein the structural latching module is secured to an intrusion beam disposed within a vehicle door.

52. The latch of claim 15, wherein the housing is formed by injection molding technique.

53. The latch of claim 21, wherein the actuation means are formed of plastic material.

54. An integrated structural latch for vehicle doors comprising a structural latching module and a non-structural latching module;

the structural latching module comprising a metal plate having an opening therethrough and having a ratchet disposed on one side of the opening and a pawl disposed on the other side thereof, the ratchet and pawl being pivotably mounted and resiliently biased, and being secured to the metal plate upon the interior thereof;

the metal plate being bent at substantially 90° to form two substantially parallel brackets extending outwardly away from the pawl and the ratchet, the bracket extensions, one being longer than the other, for securing the metal plate to an intrusion beam proximate the opening, the bracket extension proximate the opening having a further opening therethrough at substantially 90° to the opening within the metal plate, the bracket extension remote the opening providing structural support for the integrated latch mechanism, the ratchet and pawl extending in a plane substantially parallel to the extension of the metal plate, the ratchet having disposed therethrough proximate the opening in the metal plate a notch for receiving a striker in use, and having disposed on one side of the notch a primary detent means for engagement with the pawl, having disposed on the other side of the notch a secondary detent for engagement with the pawl;

the pawl being disposed upon the opposite side of the opening in the metal plate having a detent means at one end thereof proximate the ratchet and having a tail portion remote said detent at the other end thereof;

the non-structural actuating module being secured to the structural latching module and comprising a housing formed by injection molding techniques having an opening therethrough aligned in use with the opening through the metal plate of the structural latching module, having two actuation levers formed from thermoplastic materials extending in use at substantially 90° to the extension of said opening, the first actuating lever being secured within a molded channel disposed within the housing and formed during the formation of the housing, said actuation lever having disposed upon one end thereof proximate the opening a detent portion and an elongated slot, and having formed at the other end thereof, remote said opening an elongated slot and means to secure a remote actuating device thereto, the second actuating lever being formed from thermoplastic materials and being secured in a molded channel disposed within the housing and formed during the formation of said housing, the second actuation lever having disposed at one end thereof a pivotable release lever, said release lever having an arm extending therefrom for engagement with the pawl mechanism of the structural latching module, the actuating lever having disposed at the same end proximate the release lever, an elongated slot, and having formed at the other end thereof remote said release lever, an elongated slot and an abutting surface, said abutting surface providing stop means for the movement of the second actuating lever within its channel;

having a locking lever extending substantially at 90° to the extension of said ratchet mechanism in use, and having disposed upon its surface proximate said actuating levers a pin, said pin extending through the elongated slots disposed upon the actuating levers proximate said opening, the locking lever having attached thereto remote actuation means exterior to the housing for pivoting said locking lever thus engaging or disengaging said secondary actuating lever;

whereby in use the structural latching module and the non-structural actuating module marry to form the modular structural latch, wherein all actuation components are contained within the actuation module, and all of the latching components are contained within the structural module.

55. The structural latch of claim 54, wherein a key cylinder is mounted on the metal plate on an extension arm of the metal plate, said extension arm having an annular bracket for securing a key cylinder therein, the key cylinder having a detent at one end remote a key slot within said cylinder, the detent for fastening to an actuation lever which fastens to the locking lever of the actuation module.

56. The structural latch of claim 54 or 55, wherein a handle is secured to the metal plate proximate the bracket extension for fastening the metal plate to an intrusion beam, said handle for engagement with the secondary actuating lever of the actuating module by an eccentric detent formed as an extension of the handle.

57. The structural latch of claim 54, or wherein the remote actuation means affixed to the first actuating lever is a cable release.

58. The structural latch of claim 56, wherein the remote actuation means affixed to the first actuating lever is a cable release.

59. The structural latch of claim 54, or 55, wherein resilient bumper pads are provided.

60. The structural latch of claim 56, wherein resilient bumper pads are provided.

61. The actuation means of claim 19, wherein the levers are secured within molded channels disposed with the housing.

62. The actuation means of claim 19, wherein the at least two actuating levers are formed from thermoplastic material.

63. The latching means of claim 26, wherein the ratchet and pawl extend parallel to the extension of the structural latching module.

64. The latching means of claim 27, wherein the ratchet and pawl extend parallel to the extension of the structural latching module.

65. The non-structural actuating module of claim 26, comprising resilient pads disposed within the housing for securing a striker adjacent the opening in the housing.

66. The non-structural module of claim 19, comprising at least one cable release means secured to the actuation means for disengaging the latch.

67. The non-structural module of claim 39, comprising at least one cable release means secured to the actuation means for disengaging the latch.

68. The structural latch of claim 56, wherein the remote actuation means affixed to the first actuating lever is a cable release.

69. The structural latch of claim 56, wherein resilient bumper pads are provided.

* * * * *